US007644870B2

(12) United States Patent
Alexander et al.

(10) Patent No.: US 7,644,870 B2
(45) Date of Patent: Jan. 12, 2010

(54) SELF-FLUSHING SPRINKLER MECHANISM

(75) Inventors: Mona-Lisa Alexander, San Marino, CA (US); Bradley D. Helzer, Ontario, CA (US)

(73) Assignee: Rain Bird Corporation, Azusa, CA (US)

( * ) Notice: Subject to any disclaimer, the term of this patent is extended or adjusted under 35 U.S.C. 154(b) by 476 days.

(21) Appl. No.: 11/516,115

(22) Filed: Sep. 6, 2006

(65) Prior Publication Data

US 2008/0054092 A1 Mar. 6, 2008

(51) Int. Cl.
*B05B 17/00* (2006.01)
*B05B 15/02* (2006.01)

(52) U.S. Cl. ..... 239/1; 239/71; 239/106; 239/112; 239/113; 239/203; 239/206; 239/237; 239/240; 239/DIG. 4

(58) Field of Classification Search ..... 239/104, 239/106, 112–115, 123, 203–206, 237–242, 239/DIG. 4, 1, 71
See application file for complete search history.

(56) References Cited

U.S. PATENT DOCUMENTS 4,616,780 A * 10/1986 Abbott ..... 239/113
4,625,914 A 12/1986 Sexton et al.
4,787,558 A 11/1988 Sexton et al.
5,226,599 A * 7/1993 Lindermeir et al. ..... 239/205
5,383,600 A 1/1995 Verbera et al.
5,695,123 A 12/1997 Le
5,758,827 A 6/1998 Van Le et al.
5,875,969 A * 3/1999 Grundy ..... 239/113
6,050,502 A 4/2000 Clark
6,138,924 A 10/2000 Hunter et al.
6,299,075 B1 * 10/2001 Koller ..... 239/106
6,695,223 B2 2/2004 Beutler et al.
6,732,950 B2 5/2004 Ingham, Jr. et al.
6,817,543 B2 11/2004 Clark
6,840,460 B2 1/2005 Clark
6,848,632 B2 2/2005 Clark
6,871,795 B2 3/2005 Anuskiewicz
6,929,194 B2 8/2005 Lawson
2006/0108446 A1 5/2006 Yeh et al.

OTHER PUBLICATIONS

Rain Bird Corporation, Brochure of 5000 Series Rotor, Oct. 2004, 4 pages.
Rain Bird Corporation, Brochure of 5000 Series Plus Rotor, Oct. 2004, 4 pages.

* cited by examiner

*Primary Examiner*—Steven J Ganey
(74) *Attorney, Agent, or Firm*—Fitch, Even, Tabin & Flannery

(57) ABSTRACT

An irrigation sprinkler is provided having a turret for the distribution of irrigation water that includes a self-flushing mechanism to prevent accumulation of debris in a sprinkler control member and/or the interior of the turret. The sprinkler includes a main flow path that delivers water to a nozzle for irrigation and a secondary flow path that delivers water to flush part of the member and/or interior of the turret. The secondary flow path delivers water when the sprinkler cycles on and when the sprinkler cycles off. For example, with a pop-up sprinkler, the secondary flow path would deliver fluid sometime during its movement to the elevated position and movement to the retracted position.

25 Claims, 6 Drawing Sheets

SELF-FLUSHING SPRINKLER MECHANISM

FIELD OF THE INVENTION

This invention relates to irrigation sprinklers and more particularly, to a self-flushing mechanism for rotary irrigation sprinklers.

BACKGROUND OF THE INVENTION

Pop-up irrigation sprinklers are typically buried in the ground and include a stationary housing and a riser assembly, mounted within the housing, that cycles up and down during an irrigation cycle. During an irrigation cycle, the riser assembly is propelled through an open upper end of the housing and projects above ground level, or "pops up," to distribute water to surrounding terrain. More specifically, pressurized water is supplied to the sprinkler through a water supply line attached to an inlet of the housing. The pressurized water causes the riser assembly to travel upwards against the bias of a spring to the elevated spraying position above the sprinkler housing to distribute water to surrounding terrain through one or more spray nozzles. When the irrigation cycle is completed, the pressurized water supply is shut off and the riser is spring-retracted back into the sprinkler housing so that the housing and riser assembly are again at and below ground level.

A rotary sprinkler commonly includes a rotatable turret mounted at the upper end of the riser assembly. The turret includes one or more spray nozzles for distributing water and is rotated through an adjustable arcuate water distribution pattern.

Rotary sprinklers commonly include a water-driven motor to transfer energy of the incoming water into a source of power to rotate the turret. One common mechanism uses a water-driven turbine and a gear reduction system to convert the high speed rotation of the turbine into relatively low speed turret rotation. Some examples of rotary sprinklers include the sprinklers described in U.S. Pat. Nos. 4,625,914; 4,787,558; 5,383,600; 6,732,950; and 6,929,194; all assigned to the assignee of this application, Rain Bird Corporation.

During normal operation, the turret rotates to distribute water outwardly over surrounding terrain in an arcuate pattern. Rotary sprinklers commonly employ an arc adjustment mechanism, accessible from the top of the turret, to adjust the arcuate range of the turret. The arc adjustment member typically is a screw or shaft with a slotted first end manually adjustable by a tool, such as a screwdriver, to set end limits of rotation for the turret. In one example, as described in U.S. Pat. No. 5,383,600, the arc adjustment member is used to change the relative arcuate distance between two trip stops that define the limits of rotation for the turret. One trip stop is fixed with respect to the turret while the second trip stop, operatively coupled to the second end of the adjustment screw, can be selectively moved arcuately relative to the turret to increase or decrease the desired arc of coverage.

During the course of normal operation, sand particles, grit, and other debris tend to accumulate in, and become trapped in, the tool-engaging slot of the arc adjustment member. After a certain amount of accumulation, the slot of the arc adjustment member becomes too clogged with such debris so as to prevent engagement with an appropriate hand tool. Attempts to engage the clogged slot with the hand tool often result in disintegration of the head of the arc adjustment member. The end result is that the arc adjustment member ceases to function, and the user can no longer adjust the water distribution arc of the sprinkler. It has been estimated that 70% to 80% of arc adjustment failures are due to the arc adjustment slot becoming damaged or otherwise failing to function in this manner.

Accordingly, a need exists to periodically flush the slot of the arc adjustment member to minimize the accumulation of sand particles, grit, and other debris. There is a need for a self-flushing mechanism that prevents damage to the slot and failure of the arc adjustment member. Further, there is a need to flush the slot in a manner that does not result in the unduly wasteful use of water. In addition, there is a need to flush other adjustment members and other areas of the interior of the turret that are prone to accumulation of grit and other debris.

DESCRIPTION OF THE PREFERRED EMBODIMENT

Figure 1:
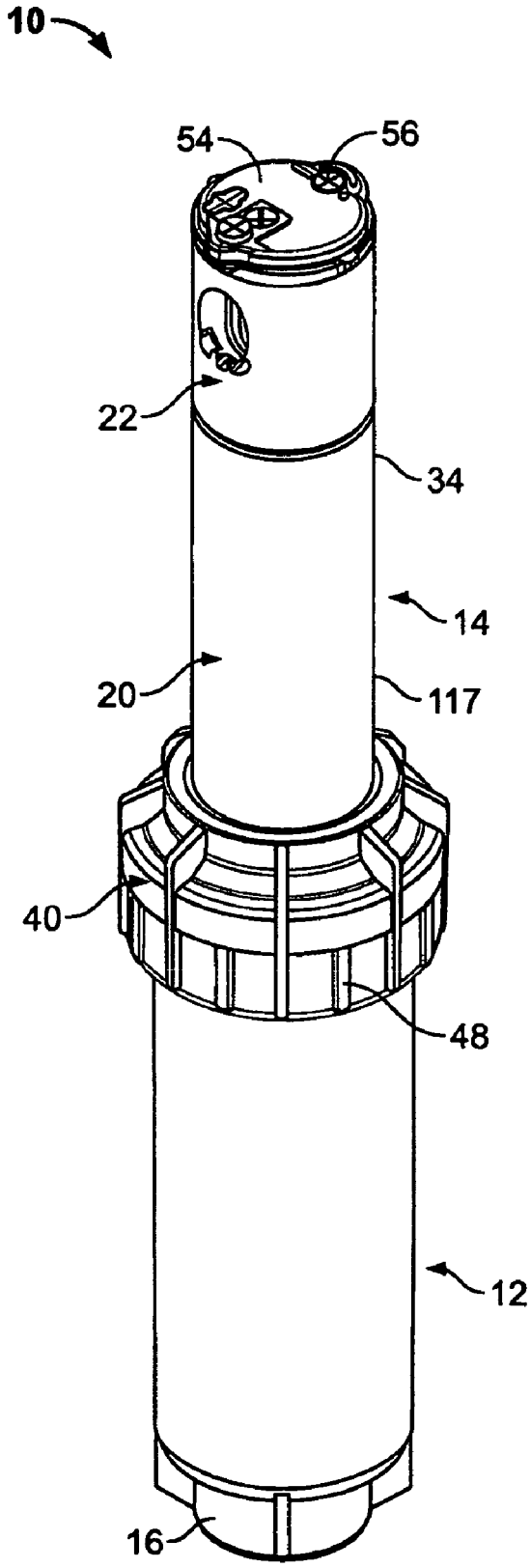
FIG. 1 is a perspective view of an irrigation sprinkler embodying features of the present invention with a riser assembly in an elevated position for distributing water therefrom.
Figure 2:
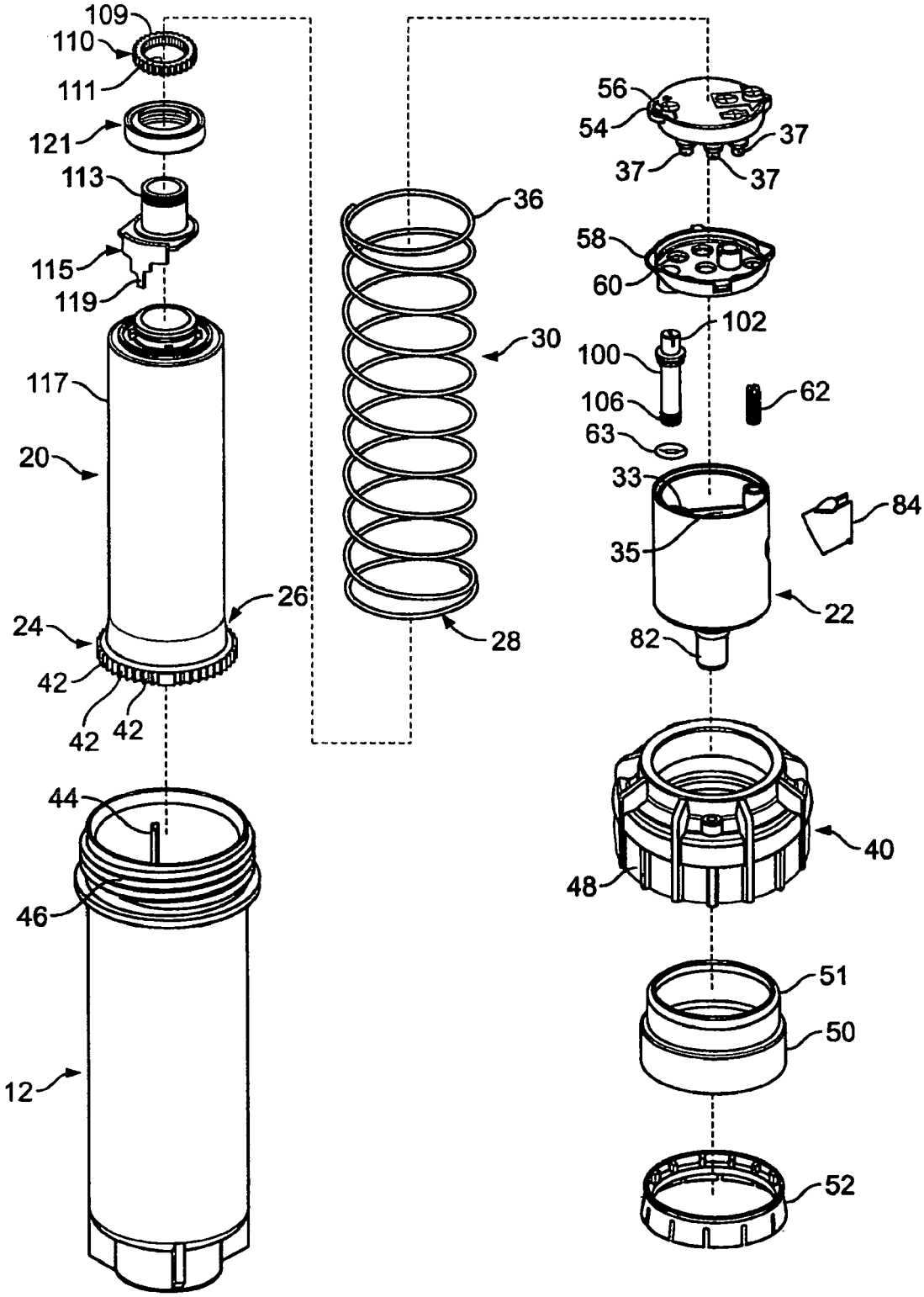
FIG. 2 is an exploded perspective view of some of the components of the irrigation sprinkler of FIG. 1.
Figure 3:
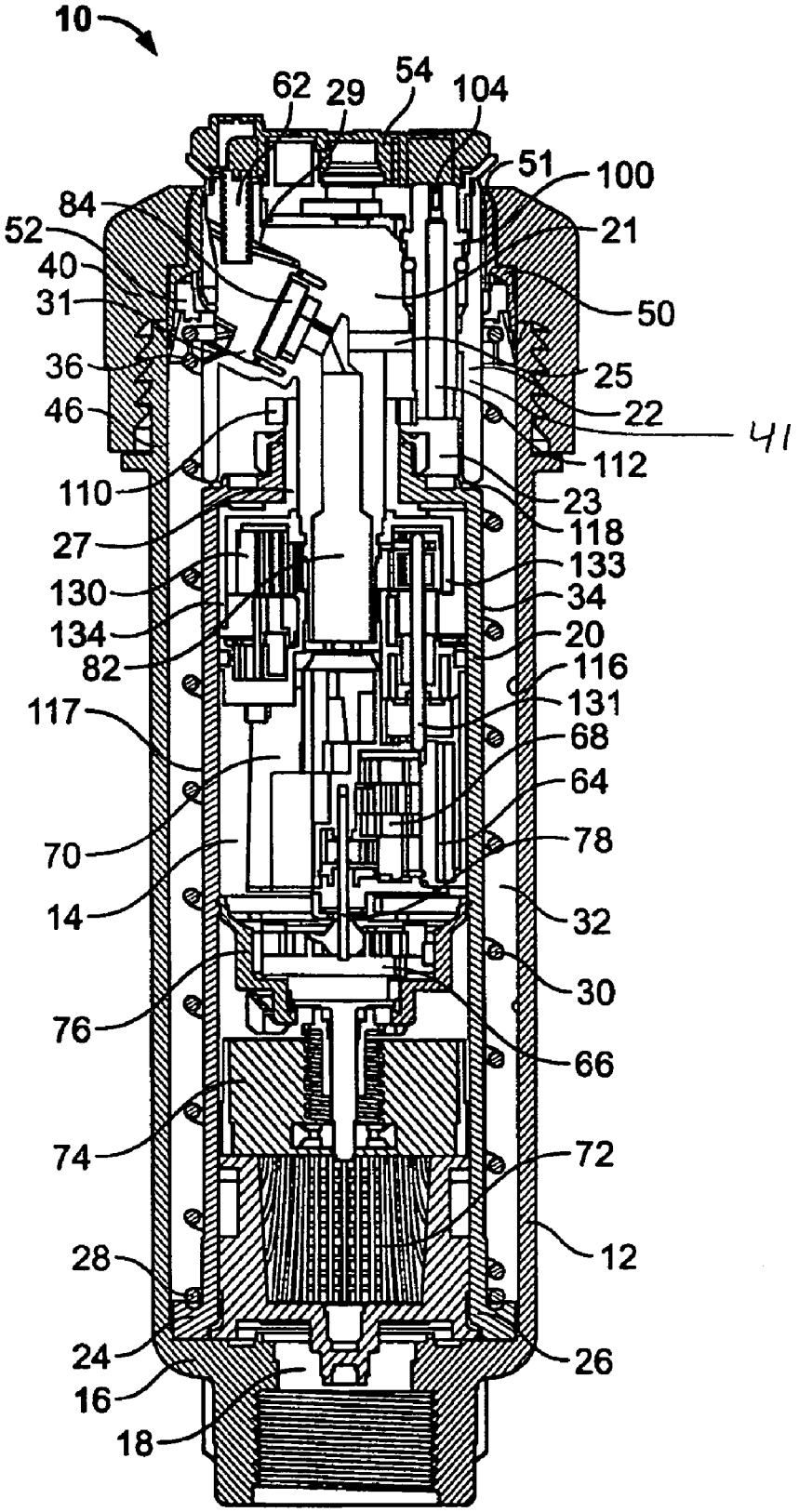
FIG. 3 is a side elevational cross-sectional view of the irrigation sprinkler of FIG. 1 with the riser assembly in a retracted position.
Figure 4:
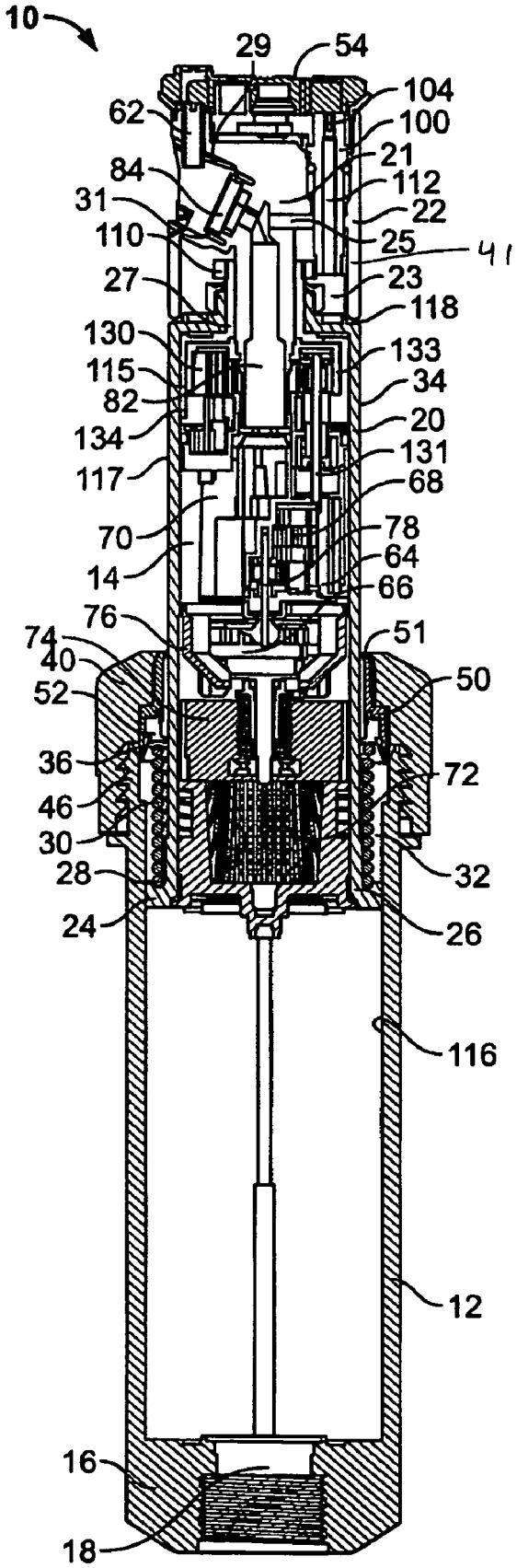
FIG. 4 is a side elevational cross-sectional view of the irrigation sprinkler of FIG. 1 with the riser assembly in an elevated position.

As shown in FIGS. 1-5, a rotary pop-up sprinkler 10 is provided having an arc adjustment member 100 that is automatically flushed every irrigation cycle to prevent failure of the arc adjustment member 100. The sprinkler 10 generally includes a housing 12 and a riser assembly 14. The riser assembly 14 travels cyclically between a spring-retracted position, as shown in FIG. 3, and an elevated spraying position, as shown in FIGS. 1 and 4, in response to water pressure. More specifically, when the supply water is on, i.e., pressurized for a watering cycle, the riser assembly 14 extends ("pops up") above ground level so that water can be distributed to the terrain for irrigation. When the water is shut off at the end of a watering cycle, the riser assembly 14 retracts into the housing 12 where it is protected from damage.

The housing 12 provides a protective covering for the riser assembly 14 and serves as a conduit for incoming water under pressure. The housing 12 preferably has the general shape of a cylindrical tube and is preferably made of a sturdy lightweight injection molded plastic or similar material. The housing 12 has a lower end 16 with an inlet 18 that is threaded to connect to a correspondingly threaded outlet of a water supply pipe (not shown). The sprinkler 10 may be one of a plurality of coordinated sprinklers 10 in an irrigation network.

The riser assembly 14 includes a non-rotatable stem 20 with a lower end 26 and an upper end 27. A rotatable turret 22 is mounted on the upper end 27 of the stem 20. The turret 22 rotates to water a predetermined arcuate pattern manually adjustable from 0 degrees to 360 degrees. The sprinkler 10 includes a reversing gear drive mechanism 130 that switches the direction of rotation of the turret 22 to create the desired arcuate sweep. The arc adjustment member 100 allows one to manually adjust the arcuate sweep settings, as described further below.

The stem 20 is generally an elongated hollow tube, which is preferably made of a lightweight molded plastic or similar material. The lower end 26 includes a radially projecting annular flange 24. The flange 24 preferably includes a plurality of circumferentially spaced grooves 42 that cooperate with internal ribs 44 of the housing 12 to prevent the stem 20 from rotating relative to the housing 12. A coil spring 30 for retracting the riser assembly 14 is disposed in the housing 12 about the outside surface 34 of the riser assembly 14. The spring 30 has a bottom coil 28 that engages the flange 24 and an upper coil 36 seated against the inside of a housing cover 40.

The housing cover 40 serves to minimize the introduction of dirt and other debris into the housing 12. The housing cover 40 preferably has internal threads and is mounted to an upper end 46 of the housing 12 which has corresponding threads. The housing cover 40 also preferably includes a grippable external surface that preferably includes a plurality of vertically extending ribs 48 for enhanced gripping and easy mounting of the sprinkler 10 to a water supply pipe outlet.

The housing cover 40 is fitted with a seal 50, preferably a ring-shaped wiper seal, mounted on the inside of the cover 40. More specifically, the support ring 52 seats the wiper seal 50 against the inside of the housing cover 40. The wiper seal 50 preferably has an annular lip 51 that slideably engages the outside of the riser assembly 14, as it reciprocates in and out of the housing 12 to wipe the outside of the riser assembly 14. This wiping action minimizes the amount of debris entering the housing 12 through the space between the housing 12 and the riser assembly 14 and on the surface of the riser assembly 14.

Figure 5:
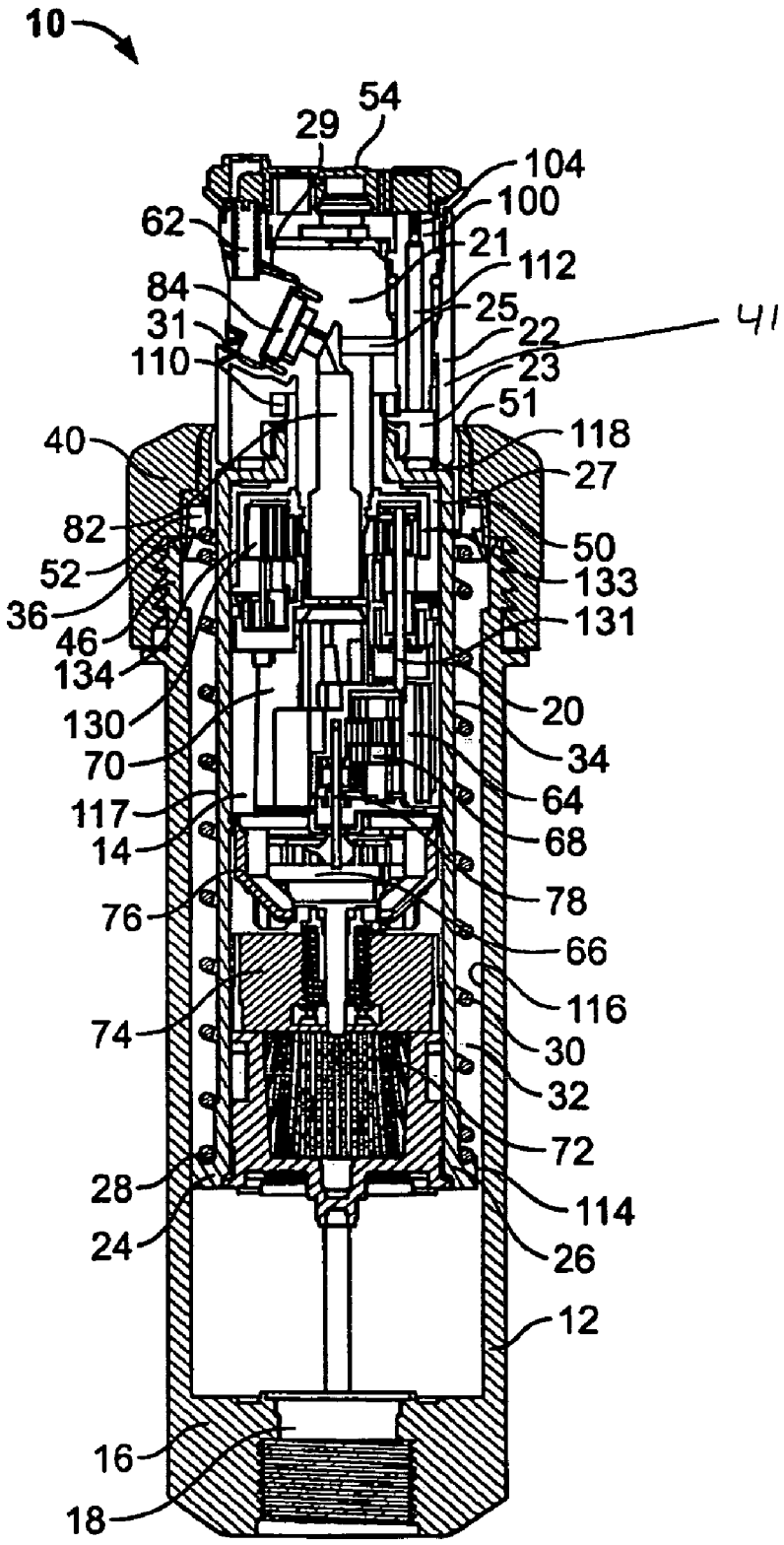
FIG. 5 is a side elevational cross-sectional view of the irrigation sprinkler of FIG. 1 with the riser assembly in an intermediate position between the retracted and elevated positions.

As shown in FIGS. 3-5, the turret 22 defines an upper recess 21 and a lower recess 23, which are separated by a partitioning wall 25 and the upper portion 29 of the nozzle insert socket 31. The turret 22 includes one or more flushing orifices 39 for flushing debris from predetermined areas of the interior of the turret 22 to the exterior of the turret 22. In one form, as shown in FIGS. 6-9, the one or more flushing orifices 39 may be defined by a flow passage 112. In alternative forms, the one or more flushing orifices 39 may extend through partitioning wall 25 and/or may extend through the outer wall 41 that defines the lower recess 23. As described further below, water exits from the one or more flushing orifices 39 as the riser assembly 14 cycles between the spring-retracted position and the elevated spraying position.

A turret cover 54, preferably made of rubber or some other elastomer material, is mounted atop the turret 22 to close the top of the upper recess 21 and provide protection against damage. The turret cover 54 includes protective access ports formed by slits 56 disposed in the top of the turret 22 (FIG. 2) to enable insertion of a hand tool for manual control of various features of the sprinkler 10 or to allow discharge of water from a flushing orifice 39 in the partitioning wall 25. The turret cover 54 also reduces accumulation of particles and other debris in the top of the turret 22.

Figure 9:
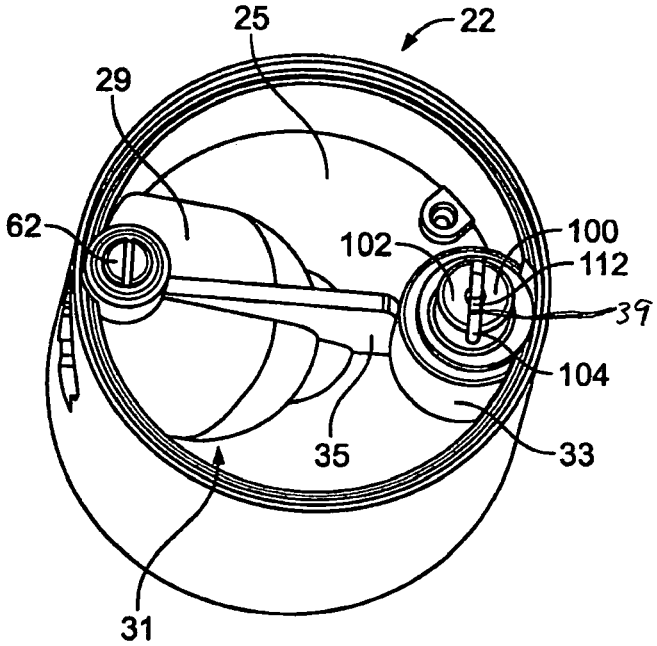
FIG. 9 is a top perspective view of a turret of the irrigation sprinkler of FIG. 1.

As shown in FIG. 2, the sprinkler 10 also preferably includes a turret cap 58 disposed beneath the turret cover 54 in the upper recess 21 and defining a number of holes 60 to seat and support the slotted free ends of screws or shafts for the manual control of various sprinkler features. For example, a radius reduction screw 62 to secure a nozzle insert 84 and to adjust the throw radius of the sprinkler 10 is seated in one of the holes 60 and extends downward through the upper portion 29 of the nozzle insert socket 31. The arc adjustment member 100 extends through the partitioning wall 25 and an upstanding support sleeve 33 extending into the upper recess 21. A support web 35 extends across the upper recess 21 between the support sleeve 33 and the upper portion 29 of the nozzle insert socket 31 (FIG. 9). The arc adjustment member 100 seals with the support sleeve 33 using an o-ring 63, and is preferably seated in one of the holes 60 of the turret cap 58 to support manual control of the arc through which water is distributed by the rotatable turret 22. In addition, the holes 60 of the turret cap 58 may be configured to provide an opening for the discharge of water from a flushing orifice 39 in the partitioning wall 25. The turret cover 54 also preferably includes one or more downwardly projecting bosses 37 that are received by the holes 60, such as by press fitting, for coupling the turret cover 54 to the turret cap 58 (FIG. 2).

As shown in FIGS. 3-5, a motor assembly 64 is mounted in the stem 20 and rotates the turret 22. Water under pressure supplied to the sprinkler housing 12 preferably provides the power for rotatably driving the turret 22, although numerous other conventional ways of providing power to the turret 22 may be used. The motor assembly 64 preferably includes a water-driven turbine 66 and a gear reduction assembly 68, which are operatively coupled to rotate the turret 22.

When the riser assembly 14 is in the elevated spray position, water flows into the stem 20 and causes the turret 22 to rotate. More specifically, water enters the housing 12 through the inlet 18 and passes through the housing 12 to the riser assembly 14. The water passes through a filter 72 mounted within the lower end 26 of the stem 20. The filter 72 prevents grit and other debris from flowing through the riser assembly 14 to enter the riser assembly 14 and possibly causing damage to sensitive sprinkler components downstream of the riser inlet.

Water flows past the filter 72 and through a spacer 74 and a stator 76 to rotatably drive the turbine 66, which rotates at a high rate of speed, such as on the order of nearly 1900 revolutions per minute ("RPM"). In turn, the turbine 66 is connected to an axle 78, which, in turn, is coupled to a series of reduction gears of the gear reduction assembly 68. The gear reduction assembly 68 operatively couples the turbine 66 to the turret 22 and reduces the rotation so that the turret 22 rotates at a relatively much lower rate of speed, such as on the order of 1 RPM. In general, the gear reduction assembly 68 reduces the relatively high speed rotation of the water-driven turbine 66 to a relatively low rotational speed suitable for rotational driving of the turret 22 to provide proper irrigation.

After flowing past the turbine 66, water continues to flow through flow passage 70 and into the turret 22 through the flow tube 82. As shown in FIGS. 2-5, the turret 22 is supported by a flow tube 82 extending from the gear reduction assembly 68 into the turret 22. The reduction assembly 68 drivingly engages the lower end of the main drive shaft 131 of the reversing gear drive mechanism 130. The upper end of the drive shaft 131 is engaged to the ring gear 133, which is fixedly attached to the turret 22 so that the turret 22 rotates with the main drive shaft 131. The flow tube 82 is hollow and provides a conduit for water to be delivered from the flow passage 70 to the nozzle insert 84 to be discharged for irrigation.

Figure 6:
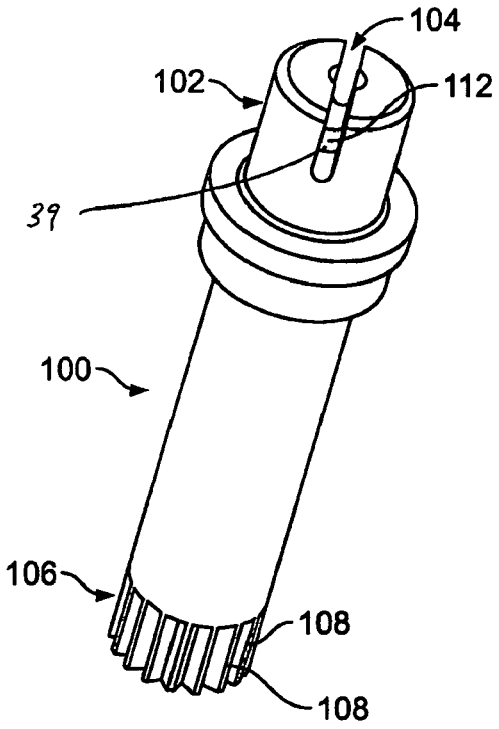
FIG. 6 is a perspective view of an arc adjustment member of the irrigation sprinkler of FIG. 1.
Figure 7:
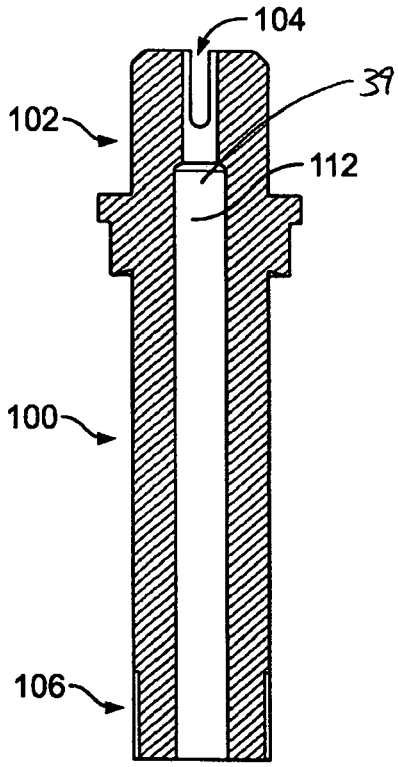
FIG. 7 is a side elevational cross-sectional view of the arc adjustment member of FIG. 6.
Figure 8:
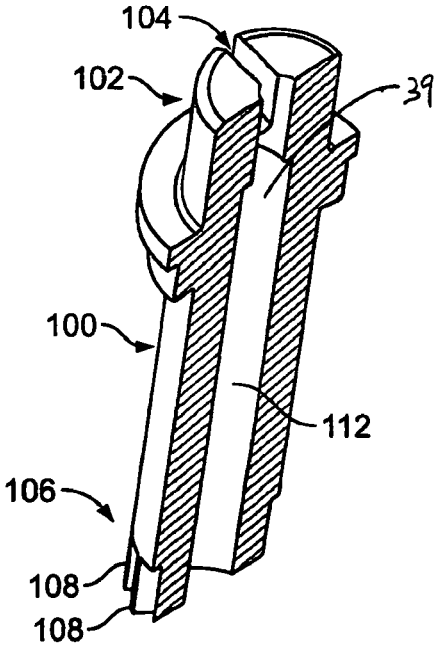
FIG. 8 is a perspective cross-sectional view of the arc adjustment member of FIG. 6 showing a flow passage extending therethrough.

As shown in FIGS. 6-8, the preferred arc adjustment member 100 is generally an elongated shaft with a first end 102 defining a slot 104, or similarly engageable surface feature, that is accessible to and may be manually adjusted through the use of a screwdriver or other hand tool. A second end 106 of the member 100 preferably includes teeth 108 that are adapted to mate with corresponding teeth 109 disposed about the external circumference of a ring-shaped second gear 110 (FIGS. 2-5) for setting one or both of the arc limits of the turret 22 through the adjustment of one or more trip stops. The second gear 110 also includes teeth 111 that are disposed about its inside circumference that mate with corresponding teeth 113 of a trip member 115 for rotation of the trip member 115. A trip stop 119 is integrally formed with, and projects downwardly from, the trip member 115. Thus, upon rotation of the arc adjustment member 100, the trip stop 119 is moved relative to a fixed second trip stop 134 on the ring gear 133 to set the range of arcuate sweep for the turret 22. The arc limits also may be set in accordance with any conventional manner of coupling the arc adjustment member 100 to the trip stops for the turret 22, such as that described in U.S. Pat. No. 5,383,600, which is incorporated in its entirety by reference. In addition, a dust cover 121 is seated on the trip member 115 for protecting the inside of the riser 14 from grit and debris.

The arc adjustment member 100 defines an elongated second flow passage 112 extending centrally therethrough. During flushing operation, as discussed further below, water flows through the second flow passage 112 from the second end 106 to the first end 102 to flush debris from the slot 104 (FIG. 9) and lower recess 23 of the turret 22.

With reference to FIG. 5, as water flows into the riser assembly 14 and the riser assembly 14 begins to rise from a retracted position to an elevated position, water flows along two flow paths. One flow path, described above, is through the lower end 26 of the stem 20, through the flow passage 70 of the riser assembly 14, and out through the nozzle insert 84 to distribute water to surrounding terrain.

The second flow path is within the housing 12 but outside the stem 20. Water first flows through a first gap 114 defined by grooves 42 of the flange 24 of the riser assembly 14 (FIG. 2) and the inner surface 116 of the housing 12. Water then flows into and fills the cavity 32 in which the spring 30 is located, which is defined by the outer surface 117 of the stem 20, the inner surface 116 of the housing 12, and the lip 51 of the wiper seal 50 (the lip 51 sealingly engages the riser assembly 14). Water next flows through a second gap 118 defined by the stem 20 and the turret 22 and into the lower recess 23 and fills the lower recess 23 under pressure. Water flows from the lower recess 23 through the second end 106, the second flow passage 112, and the first end 102 of the arc adjustment member 100 to flush and clean the slot 104 and flush debris from slot 104 and lower recess 23.

This flushing action causes a relatively high pressure pulsing action, on the order of 5-6 pounds per square inch ("psi"), which serves to clean other sensitive parts of the sprinkler 10 that are prone to clogging. For example, the flushing water is forced out through the slit 56 overlaying the slotted first end 102 of the arc adjustment member 100, thereby cleaning the slit 56. Also, the flushing action has been found to clean debris from the interior of the turret 22 near the second gap 118, including cleaning debris from the gear teeth of both the arc adjustment member 100 and the corresponding mating second gear 110, as water flows cyclically into and out of the lower recess 23 of the turret 22. Further, flushing water is forced out of the second flow passage 112 in the turret 22 for cleaning debris from desired areas of the interior of the turret 22.

The flushing action occurs when the riser assembly 14 is traveling between a retracted position and an elevated position. The slot 104 is preferably flushed once as the riser assembly 14 starts moving upward and once as the riser assembly 14 is returning to a retracted position. Thus, the slot 104 is flushed twice during an ordinary irrigation cycle, as described below.

The second flow path receives water while the second gap 118 is below the lip 51 of the wiper seal 50. As the riser assembly 14 continues to move upward, however, the second flow path eventually leaves communication with the water supply when the second gap 118 rises above the lip 51 of the wiper seal 50, e.g., when the bottom of the turret 22 is spaced above the top of the housing cover 40. Thus, when a cycle begins and water initially flows into the housing 12 and riser assembly 14, a pulse of water is transmitted through the second flow passage 112 to flush slot 104 and through the overlaying slit 56 in the turret cover 54.

The same flushing action is repeated when the riser assembly 14 returns from an elevated spray position to a retracted position. When the riser assembly 14 is in the elevated position, the second flow passage 112 is not in communication with the water supply because the second gap 118 is spaced outside the housing 12. However, as the riser assembly 14 continues to return to its retracted position, the second gap 118 eventually passes below the lip 51 of the wiper seal 50, thereby placing the second flow passage in communication with the water supply. Thus, as the irrigation cycle ends and the spring 30 returns the riser assembly 14 to its retracted position, a second pulse of water is transmitted through the second flow passage 112 to flush slot 104 and slit 56.

The periodic flushing of the arc adjustment member 100 and interior of the turret 22 prevents accumulation of sand particles and other debris and is effective to maintain the operation of various components of the arc adjustment mechanism. In contrast, the accumulation of sand particles and other debris in arc adjustment members can prevent a screwdriver or other hand tool from freely engaging member 100, thereby making routine adjustments difficult, and cause deterioration of the engaging components.

Experience has shown that the size of the cross-section diameter of the second flow passage 112 impacts the effectiveness of the flushing. For example, a flow passage 112 having a cross-sectional diameter of 0.062 inches at the first end 102 was effective in flushing all of the units having that cross-sectional diameter, whereas a flow passage 112 having a cross-sectional diameter of 0.040 inches at the first end 102 was effective in flushing only about 80% of the units having that diameter. The larger diameter passage 112 at the first end 102 was more effective in maintaining the slot 104 free of sand and grit and allowed a screwdriver to freely engage the slot 104. It should be evident that the desired diameter of the flow passage 112 will depend on the size and configuration of the arc adjustment member 100.

Although one form of an arc adjustment member 100 is shown in FIGS. 6-8, it should be evident that numerous other forms and configurations are available. The member 100 may be used to control the operation of features of the sprinkler 10 other than adjustment of the arc traversed by the turret 22, and more than one member 100 may be flushed during each cycle. Further, many other shapes and sizes are available that define a flow passage therethrough that permits water flow to the end of the member 100 to be flushed. Further, the member 100 is not necessarily limited to control of the arc adjustment feature of the sprinkler 10. Instead, the member 100 being flushed may be some other sprinkler control member used to control the operation of features of the sprinkler 10 other than adjustment of the arc traversed by the turret 22. In addition, there is no limitation that only one such member 100 be flushed, and the sprinkler 10 may include multiple control members that are flushed during each cycle of the sprinkler 10.

In addition, other forms of the sprinkler 10 may include an adjustment member 100 with a flow passage 112 therethrough and/or one or more other flushing orifices 39. More specifically, as described above, the sprinkler 10 may include adjustment member 100, which defines a flushing orifice through the turret 22, and need not include other flushing orifices 39. Alternatively, other embodiments may include one or more flushing orifices 39 to flush debris from the interior of the turret 22 and need not include an adjustment member 100 with a flow passage 112 therethrough. Moreover, other forms of the sprinkler 10 may not flush a member 100 at all but may instead flush a predetermined portion of the interior of the turret 22. More specifically, other forms of the sprinkler 10 may flush water out through a flushing orifice 39 in the outer wall 41 that defines the lower recess 23 of the turret 22 and/or through the partitioning wall 25 for cleaning debris from desired areas of the interior of the turret 22. In such forms, water exits the flushing orifice 39 as the riser assembly 14 cycles between the spring-retracted position and the elevated spraying position.

The foregoing relates to preferred exemplary embodiments of the invention. It is understood that other embodiments and variants are possible which lie within the spirit and scope of the invention as set forth in the following claims.

What is claimed is:

1. An irrigation sprinkler comprising:

a housing with an inlet for receiving pressurized fluid for irrigation;

a riser assembly mounted to the housing;

a turret mounted on the riser assembly, having one or more nozzles attached thereto for discharging pressurized fluid from the sprinkler for irrigation, and having a flushing passage separate from the one or more nozzles;

the riser assembly and the turret being moveable between a retracted position and an elevated position relative to the housing; and the housing, the riser assembly and the turret defining a first flow path extending from the inlet to the one or more nozzles and outwardly from the turret for irrigation and defining a second flow path extending from the inlet to the flushing passage;

wherein the inlet is not in fluid communication with the flushing passage when the riser assembly is in the elevated position.

2. An irrigation sprinkler comprising:

a housing with an inlet for receiving pressurized fluid for irrigation;

a riser assembly mounted to the housing;

a turret defining an interior and being mounted on the riser assembly for discharging pressurized fluid from the sprinkler for irrigation;

the riser assembly and the turret being moveable between a retracted position and an elevated position relative to the housing;

the housing, the riser assembly and the turret defining at least in part a conduit for pressurized fluid flow for irrigation;

the riser assembly and the turret defining an inlet passage to permit pressurized fluid into the interior of the turret from the housing; and an arc adjustment member operatively coupled to the turret to select the arc traversed by the turret during irrigation, the arc adjustment member having an outlet end configured for manual operation of the arc adjustment member, an inlet end for receiving pressurized fluid from the interior of the turret, and defining a first fluid passage between the inlet end and the outlet end to flush debris from at least the outlet end of the arc adjustment member.

3. The irrigation sprinkler of claim 2 wherein the riser assembly further comprises a stem and the turret being rotatably mounted on the stem, and the stem and turret defining a second fluid passage therebetween for fluid flow to the inlet end of the arc adjustment member and through the first fluid passage to flush the outlet end.

4. The irrigation sprinkler of claim 3 further comprising a spring disposed in the housing to bias the riser assembly to the retracted position, and wherein the riser assembly moves from the retracted position to the elevated position in response to fluid flowing into the housing sufficient to overcome the bias of the spring.

5. The irrigation sprinkler of claim 4 further comprising a seal at or adjacent an upper end portion of the housing for slideably engaging the riser assembly as the riser assembly travels between the retracted and elevated positions.

6. The irrigation sprinkler of claim 5 wherein fluid flows into the second fluid passage when the second fluid passage is positioned below the seal.

7. The irrigation sprinkler of claim 6 wherein fluid stops flowing into the second fluid passage when the first fluid passage is positioned above the seal.

8. The irrigation sprinkler of claim 7 wherein the stem has an inlet end for receiving fluid into the stem, the inlet end having exterior grooves spaced peripherally thereabout, the grooves defining a portion of a flow path for fluid flow to the second fluid passage.

9. The irrigation sprinkler of claim 5 further comprising a housing cover at the upper end portion and the seal being mounted on an inner portion of the cover for slideably engaging the riser assembly as the riser assembly travels between the retracted and elevated positions.

10. The irrigation sprinkler of claim 5 wherein the seal is a ring-shaped seal having a wiper lip for slideably engaging the riser assembly.

11. The irrigation sprinkler of claim 2 further comprising a motor assembly mounted within the stem and operatively coupled to the turret for rotation of the turret.

12. The irrigation sprinkler of claim 11 wherein the motor assembly comprises a fluid driven turbine and a gear assembly operatively coupled to the turbine, the turbine transmitting power to the gear assembly and the gear assembly transmitting power to the turret for rotation of the turret relative to the housing.

13. The irrigation sprinkler of claim 2 wherein the arc adjustment member includes a hollow shaft that defines at least in part the first fluid passage.

14. The irrigation sprinkler of claim 13 wherein the shaft includes the outlet end of the arc adjustment member and the outlet end being adapted for cooperation with a tool.

15. The irrigation sprinkler of claim 2 wherein the inlet end of the arc adjustment member includes gear teeth operatively coupled to a trip member to set at least one limit of rotation for the turret.

16. An irrigation sprinkler comprising:

a housing with an inlet for receiving pressurized fluid;

a riser assembly mounted to the housing and moveable between a retracted position and an elevated position, the housing and the riser assembly defining a first fluid passage;

the riser assembly including a stem and a turret mounted thereon for rotation through a predetermined arc, the turret having one or more nozzles attached thereto for ejecting at least one stream of fluid outwardly from the riser assembly, the stem and turret defining a second fluid passage therebetween;

a fluid driven turbine mounted for rotation at the stem;

a gear assembly mounted at the stem and operatively coupled to the turbine, the turbine transmitting power to the gear assembly and the gear assembly transmitting power to the turret for rotation of the turret relative to the stem;

an adjustment member operatively coupled to the turret to adjust the predetermined arc to be traversed by the turret, the arc adjustment member defining a third fluid passage and having a first portion configured for cooperation with a tool to adjust the arc adjustment member;

a first flow path extending from the inlet through the first fluid passage to the one or more nozzles; and a second flow path extending from the inlet through the second and third fluid passages for flushing the first portion of the arc adjustment member.

17. The irrigation sprinkler of claim 16 further comprising a spring disposed in the housing to bias the riser assembly to the retracted position, and wherein the riser assembly moves from the retracted position to the elevated position in response to fluid flowing into the housing sufficient to overcome the bias of the spring.

18. The irrigation sprinkler of claim 17 wherein the housing has an upper end and further comprising a housing cover, the housing cover including a seal mounted on an inner portion thereof for slideably engaging the riser assembly as the riser assembly travels between the retracted and elevated positions.

19. The irrigation sprinkler of claim 18 wherein the second flow path receives fluid at least when the riser assembly travels between the retracted and elevated positions and the second fluid passage is below the seal.

20. The irrigation sprinkler of claim 16 wherein the stem includes an inlet end having a flange with grooves and the grooves defining a portion of the second flow path.

21. The irrigation sprinkler of claim 16 wherein the arc adjustment member includes a hollow shaft defining at least in part the third fluid passage.

22. The irrigation sprinkler of claim 16 wherein the first portion of the arc adjustment member is slotted for cooperation with a tool.

23. The irrigation sprinkler of claim 16 wherein the arc adjustment member has a second portion with gear teeth operatively coupled to a trip member to set the predetermined arc of rotation of the turret.

24. A method for flushing debris from an irrigation sprinkler comprising the steps of:

providing a sprinkler including a riser assembly mounted to a housing and defining a cavity therebetween, the housing having an inlet for receiving pressurized fluid, the riser assembly moveable between a retracted position and an elevated position relative to the housing, the riser assembly including a stem and a turret mounted thereon, the stem and turret defining a gap therebetween and the turret having a flushing passage;

transmitting fluid through a flow path defined at least in part by the inlet, the cavity, the gap, and the flushing passage, when the riser assembly is in a first intermediate position between the retracted and elevated positions; and severing the flow path when the riser assembly is in a second intermediate position between the retracted and elevated positions.

25. The method of claim 24 wherein fluid is transmitted through the flow path twice when the riser assembly completes one cycle of travel from the retracted position to the elevated position and back to the retracted position.

* * * * *

UNITED STATES PATENT AND TRADEMARK OFFICE

CERTIFICATE OF CORRECTION

PATENT NO. : 7,644,870 B2
APPLICATION NO. : 11/516115
DATED : January 12, 2010
INVENTOR(S) : Alexander et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 604 days.

Signed and Sealed this

Sixteenth Day of November, 2010

David J. Kappos

David J. Kappos
*Director of the United States Patent and Trademark Office*